US005653091A

United States Patent [19]

Stark

[11] Patent Number: 5,653,091

[45] Date of Patent: Aug. 5, 1997

[54] PROCESS FOR STERILIZING AND FILLING PACKAGES FOR FLOWABLE MEDIA, DEVICE FOR THIS PURPOSE AND USE WITH A PARTICULAR PACKAGE

[76] Inventor: Sven Olof Soren Stark, Sjorup 23, S-271 00 Ystad, Sweden

[21] Appl. No.: 501,109

[22] PCT Filed: Feb. 8, 1994

[86] PCT No.: PCT/EP94/00353

§ 371 Date: Sep. 22, 1995

§ 102(e) Date: Sep. 22, 1995

[87] PCT Pub. No.: WO94/18075

PCT Pub. Date: Aug. 18, 1994

[30] Foreign Application Priority Data

Feb. 12, 1993 [DE] Germany ..... 43 04 220.1

[51] Int. Cl.[6] ..... B65B 55/04; B65B 31/02

[52] U.S. Cl. ..... 53/426; 53/432; 53/484; 53/510; 53/167; 53/375.6

[58] Field of Search ..... 53/426, 432, 467, 53/473, 484, 510, 167, 375.6, 375.7

[56] References Cited

U.S. PATENT DOCUMENTS

| | | | |
|---|---|---|---|
| 3,393,491 | 7/1968 | Burton et al. | 53/426 X |
| 3,531,908 | 10/1970 | Rausing et al. | 53/426 |
| 3,837,137 | 9/1974 | Yassushiro et al. | 53/510 X |
| 3,970,426 | 7/1976 | Stark et al. . | |
| 4,910,942 | 3/1990 | Dunn et al. | 53/426 X |

FOREIGN PATENT DOCUMENTS

| | | |
|---|---|---|
| 2914075 | 11/1980 | Germany . |
| 239388A1 | 9/1986 | Germany . |
| 40362901A | 12/1991 | Germany . |
| 595248 | 2/1978 | Switzerland . |

*Primary Examiner*—Linda Johnson
*Attorney, Agent, or Firm*—Paul & Paul

[57] ABSTRACT

A process for sterilizing and filling packages (1) for flowable media, open on one side, under the influence of pulsating light and use of a filler pipe (5) is improved to the effect that treatment by chemical media together with its associated disadvantages in avoided. For this, the package (1), enclosing the filler pipe (5) and the light source (7), is moved sufficiently far relatively to the filler pipe (5) and to the light source (7) for the bottom edge (16) of the filler pipe (5) and the light source (7) to be located near to the closed end (3) of the package, sterile gas is blown into the package (1) and the light is allowed to take effect, and after shutting off the light source (7), the light source (7) is moved along in one direction and the package (1), being filled, is moved in the other direction, then closed and transported onwards.

10 Claims, 4 Drawing Sheets

Figure 1:
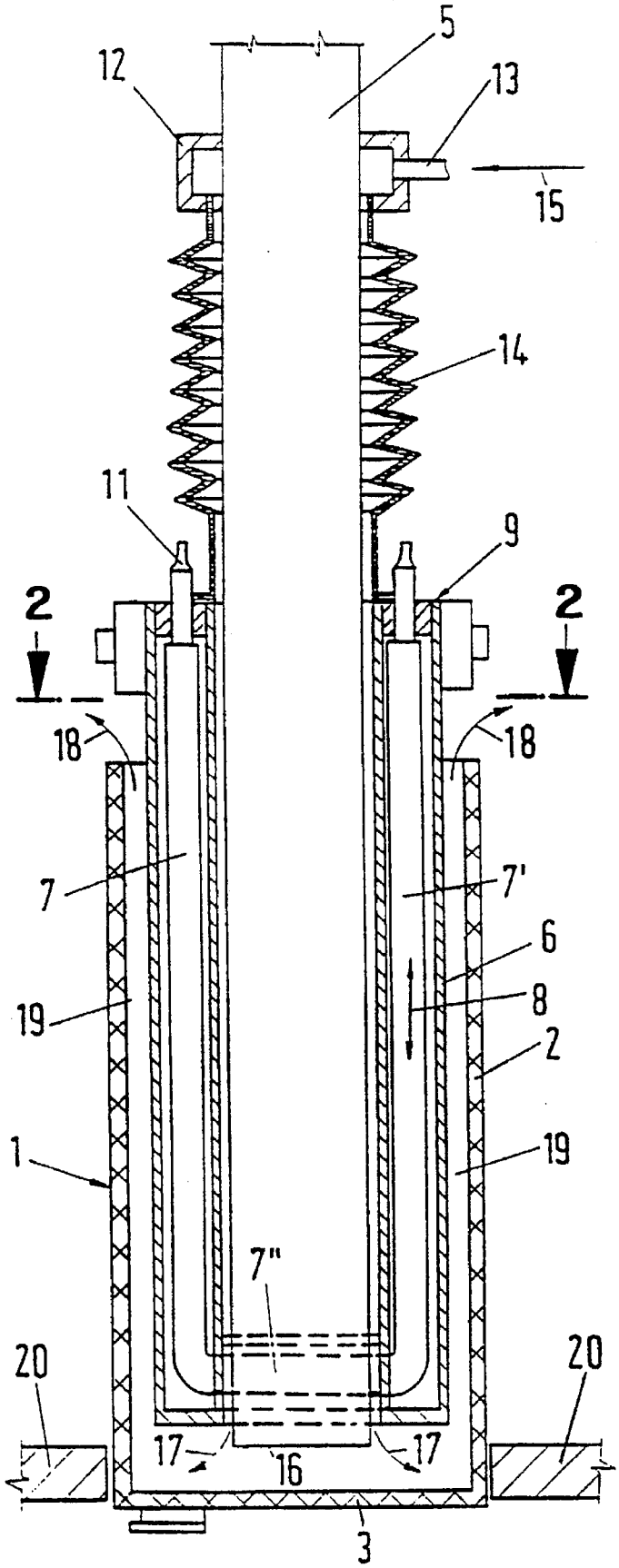

PROCESS FOR STERILIZING AND FILLING PACKAGES FOR FLOWABLE MEDIA, DEVICE FOR THIS PURPOSE AND USE WITH A PARTICULAR PACKAGE

The invention relates to a process for sterilizing and filling packages for flowable media open on one side under the influence of pulsating light and the use of a filler pipe. The invention also relates to a device with a lamp emitting a pulsating light and with a filler pipe which is moveable relative to the package and is open at its bottom edge.

It is known to sterilize packages for liquids before filling, for example packages for milk, the tubular walls of which have paper as a support material and are surface coated with one or more layers. In the known process the insides of the package are treated with chemical sterilizing media. This sterilization is disadvantageously slow and additionally the treatment of the package must take place in closed spaces, that is to say the packages must be enclosed in aseptic chambers. A further disadvantage is that the chemical sterilizing medium must be removed after completion of the process, for example by drying, in order to remove the remains of the chemical medium from the surfaces of the packages. This has resulted in complicated and expensive machines and the implementation of the known process is costly.

The object of the invention is to provide a new process and a new device of the type described in the introduction to the effect that treatment with chemical media together with its associated disadvantages is avoided, wherein the device is more practically and more simply configured and shows a quicker effect.

With respect to the process, the object of the invention is solved in that the package, enclosing the filler pipe and the light source, is moved sufficiently far relatively to the filler pipe and to the light source for the bottom edge of the filler pipe and the light source to be near to the base of the package, sterile gas is blown into the package and the light is allowed to take effect, and after shutting off the light source, the light source is moved along in one direction and the package, being filled, is moved in the other direction then closed and transported onwards. With this process high capacity packages (large numbers per unit time) can be sterilized and filled in the narrowest of spaces and therefore with compact machines, wherein preferably the sterilizing is carried out directly before and during the filling and the interior of the package above the flowable medium is kept sterile until closure.

Flowable media as a rule move downwards with greater or lesser vertical components as a result of gravity, and therefore the filling takes place, according to the invention, in a preferred embodiment, from above to below, therefore the light source in the interior of the package is moved downwards relatively to the package and during filling, and after the sterilizing effect of the light has killed off the bacteria moves upwards relatively to the bottom edge of the filler pipe so that during filling no flowable medium splashes against the lamp housing.

It is in this case advantageous when according to the invention during the entire sterilizing, filling and closure process an atmosphere with sterile gas is maintained in the interior of the package. In order that after the initial sterilization bacteria from outside do not arrive on the walls of the package or on machine parts which are used for sterilizing, filling and closing, with the present measures according to the invention it is ensured that sterile gas, for example sterile air, is continuously supplied to the interior of the package.

With appropriate throttling of the supply lines it can easily be ensured that in the interior of the package an excess pressure of sterile gas occurs and is maintained. In this way it is reliably ensured that the contents filled into the sterile package and also the space above the top level of the contents remains sterile for as long as the package is still open.

It is also particularly advantageous when during the whole operation sterile gas externally sweeps over the surface of the filler pipe. It is unavoidable, and sometimes is even desirable, for the bottom edge of the outlet aperture of the filler pipe, and therewith some surfaces of the filler pipe, to come directly into contact with the contents. When the sterile gas continuously sweeps over the surfaces of the filler pipe, bacterial contamination can advantageously be eliminated.

With respect to the device, the object described in the introduction is solved according to the invention in that the lamp is arranged in a lamp housing cooled internally with a coolant medium, adjacent to the outer surface of the stationary filler pipe, the lamp housing is driven in a moveable manner in the space between the filler pipe and the package wall, and that lines for supplying sterile gas into the interior of the package are provided. Lamps for producing pulsating light are in themselves known, and it is also known to arrange these lamps in a cooled lamp housing. The particular feature of the present invention is in the configuration and arrangement of the lamp housing, surrounding the stationarily arranged filler pipe in an at least partially annular manner. The device according to the invention can in this way be configured in a particularly compact manner and even used for sterilizing small packages as the arrangement of the lamp housing closely adjacent to the filler pipe requires little space next to a filler pipe which is generally small in the radial direction, almost always smaller than the diameter of a package tube. Lamps of different configurations can be used, for example spirally-shaped or rod-shaped lamps.

According to the invention it is not necessary to arrange lamps which are, for example, rod-shaped, close to the filler pipe to ensure a sterilizing effect over the whole periphery of the filler pipe and also as far as the package wall arranged further outside. Instead, a complete annular space is spanned by a single lamp rod by means of a rotational movement. The driving of the lamp housing is however not only to be understood in the sense of rotation, as the lamp housing can also be moved vertically upwards and downwards in a translatory manner. In this way it is possible to use annular or partially annular lamps or also short lamp rods and to sweep the whole annular space therewith. It is also possible to configure the mounting of the lamp housing with respect to the filler pipe such that if desired sterile gas can also be conducted continuously into the interior of the package during the whole operation.

It is furthermore advantageous according to the invention when the lamp and lamp housing are attached to a lifting and pivoting apparatus which surrounds the filler pipe while eliminating the lines passing through, and when the substantially vertical extent of the lamp corresponds to the substantially vertical height of the package. Although the vertical extent could be shorter, as described above, the implementation of sterilizing requires less time when the lamp produces its effect over the whole vertical extent of the package. Then pivoting of the long part of the lamp by 90°, 180° or 360° is then sufficient provided that two or only one substantially vertical part, possibly a rod-shaped part, is provided in the lamp configuration. When nevertheless a lifting apparatus is advantageous, this serves for moving the lamp, after switching off, away from the bottom edge of the filler pipe during the filling operation to ensure that no content accidentally splash onto the lamp housing.

In an advantageous manner the lamp housing is predominantly configured with a quartz glass cover. It is also undesirable due to the high temperature occurring when the lamp is in operation for contents to come into contact with the lamp housing.

The lifting apparatus also naturally serves in the lowering of the lamp housing with respect to the filler pipe, as for the actual sterilizing process the lamp housing should completely cover the area of the filler pipe which is located in the interior of the package which is open on one side, so that the entire height of the package and filler pipe can be sterilised as simultaneously as possible.

Clearly, the internal wall of the lamp housing must also be transparent and it is particularly advantageous when the filler pipe is provided externally with a layer reflecting the pulsating light, for example a layer containing metal. Then any bacteria located on the filler pipe succumb to the bombardment of the light from the lamp as well as the bombardment of the light reflecting off the surface of the filler pipe afterwards. Furthermore, in this way the power of light rays emitting radially from the whole lamp is additionally increased.

In an advantageous further embodiment of the invention the upper area of the filler pipe carries a fixed connection piece at a distance apart from the lifting and pivoting apparatus, wherein between the fixed connection piece and the lifting and pivoting apparatus a flexible bellows is mounted in a gas-tight manner and surrounds the filler pipe. Proceeding from a stationarily mounted filler pipe which serves only for the supply of contents in the interior, the supply line for sterile gas is laid in the space between the lamp housing and the filler pipe to provide as compact a configuration as possible of the device according to the invention, as this space allows the sterilization of the filler pipe externally as well as conduction of the sterilizing gas into the interior of the package. However, in order to provide this generally annular space between the filler pipe and the lamp housing with the gas supply, according to the invention the fixed connection piece is provided in the upper area of the filler pipe. "Upper area" is in this case to be understood as an area on the filler pipe which is a sufficient distance from the highest possible position of the top edge of the open package. This distance is selected so that the flexible bellows provided here according to the invention can be accommodated both in a compressed and an expanded form. As the lamp housing moves up and down in a translatory manner by means of the lifting and pivoting apparatus and is also pivoted about the angle of rotation specified, the advantageous mounting of the bellows to the lifting and pivoting apparatus in the lower area of the bellows and to the fixed connection piece at its upper area is conceived according to the invention. In a preferred embodiment the fixed connection piece is a hollow ring which is fixed to the filler pipe and ensures the transfer or the distribution of the sterile gas or sterilizing gas from outside through a supply line downwards to the bellows. The bellows surrounds the filler pipe at a radial distance and during operation is also filled with the sterile gas.

It is further advantageous when moveable sealing jaws are arranged in the area outside the bottom edge of the filler pipe. The use of the device according to the invention is conceived primarily for intermittent sterilization, of packages which have a tubular shape, one end of which, for example later forming the lid, is closed, while the other end, for example later forming the base, is open. The sterilizing device together with the latterly described embodiment is suitable in particular for sterilizing and filling packages, the tube-shape of which is composed of a foldable material. This material has to be coated with sealable layers, and a base of this type of a filled package is folded and closed by appropriate sealing jaws. The sealing jaws can be electrically or otherwise heated pressure jaws or counter pressure jaws; the same application can also be carried out using ultrasound, wherein the sealing jaws are then the front part of a sonotrode.

When the moveable sealing jaws or ultrasound jaws are arranged in the manner described adjacent to the bottom edge of the filler pipe, the distance between the top edge of the package which is still open on the one hand and the lamp housing on the other hand can advantageously be kept small, with the result that only small gaps remain between them which allows the inflow of a certain amount of sterile gas before folding and before closure of the package.

Although the escape of sterile gas is harmless and does not affect the efficiency of the operation of the device according to the invention, with another preferred embodiment of the invention it is provided that a flexible sleeve is arranged at a radial distance around the lamp housing, which is fitted at the top in a gas-tight manner in the area of the fixed connector and at the bottom is fitted closely to the top of the sealing jaws. In this way a closed space can be maintained above the open package without the sterile gas having to escape continuously in order to maintain the excess pressure of the sterile gas atmosphere. Where the lower area of the sleeve fits onto the top of the sealing jaws a gas tight connection between the sleeve and tool part at the top adjacent to the package tube can be ensured by compression or fastening, and this annular area of the sleeve can even be kept fitted to the sealing jaws during the movement thereof, so that the bottom part of the sleeve follows the sealing jaws during the folding movement. During the folding and welding movement, the space over the package can then also be kept closed.

It is particularly advantageous when according to the invention, when viewed from the side, the lamp in the lamp housing which surrounds it is U-shaped at right-angles to the translatory lifting movement, wherein the tab joining the arms of the U is arc-shaped, preferably semi-circular, when viewed from above. The plan view of the lamp housing reveals the configuration thereof in the form of a hollow ring which surrounds the filler pipe. Consequently in this hollow ring a cylindrical space is located; or rather: the spatial content is in the shape of a hollow cylinder. If in this space a lamp is arranged which, when viewed from the side is U-shaped, the arms of which extend vertically above the height of the package tube, it can clearly be understood that a pivoting of 90° of the lifting and pivoting apparatus in one direction and another is sufficient to sweep the entire surface of the filler pipe internally and of the package tube externally. Such a lamp is extremely effective and nevertheless enough space is left in the remaining hollow cylindrical space for the arrangement of cooling pipes for supplying and distributing a coolant, for example water, between the lamp and lamp housing.

The use of the process or of the device is particularly advantageous according to one of the presently described embodiments with packages for flowable media with tubular walls, on the support material of which, facing inside the package, a reflective layer is applied. Paper or polypropylene foam can be used, for example, as the support material.

On the surface of the tubular wall which, when the package is completed will form the inside, a reflective layer is applied, advantageously over a bonding agent, which will be covered from the contents by a transparent layer of polypropylene. In this case also the sterilizing effect of the light is doubled, as already described above with reference to the outwardly reflecting filler pipe. The first effect of the light impulse occurs after emission from the lamp when it meets the reflective layer and afterwards can produce the same sterilizing effect for a second time upon any bacteria. To protect the reflective layer, where desired and for particularly effective functioning, it is surrounded by a layer containing SiOx, preferably vapour deposited in plasma as a support for the reflective layer.

Further advantages, features and possibilities for use of the present invention will be described hereinafter with reference to the attached drawings, which show in FIG. 1 a cut away sectional view of an embodiment of a lamp surrounding the filler pipe, wherein the package to be filled has just been transported to its upper position in a holder for this purpose which is not shown, FIG. 2 a cross-sectional view in the direction of lifting vertically from above to below, approximately along the line II—II of FIG. 1, FIG. 3 a greatly enlarged and cut away cross-sectional view of the material of the tubular wall, FIG. 4 a similar view to FIG. 1 in a reduced scale, wherein however in positions II to V additional, different processing steps are shown, and FIG. 5 a cut away and enlarged cross-section similar to FIG. 1, wherein however another embodiment with a flexible sleeve arranged outside the lamp housing is shown.

A package 1, open on one side is to be sterilized and filled, and is composed of a tubular wall 2 and a lid 3 which is arranged at the bottom in this case as the package is transported upside down by a holder such that the contents shown in FIG. 4 as a grey area can be filled from above to below.

The filling is carried out by a filler pipe 5 which is circular in cross-section and mounted in a stationary manner. The bottom area thereof is surrounded by a lamp 7 fitted into a lamp housing 6, said lamp having, in the side view according to FIG. 1 at right angles to the plane of the paper and at right angles to the translatory direction of the lifting movement 8, 8', the form of a U-shape, the vertical arms 7' of which are joined by a curved, horizontal tab 7".

Figure 2:
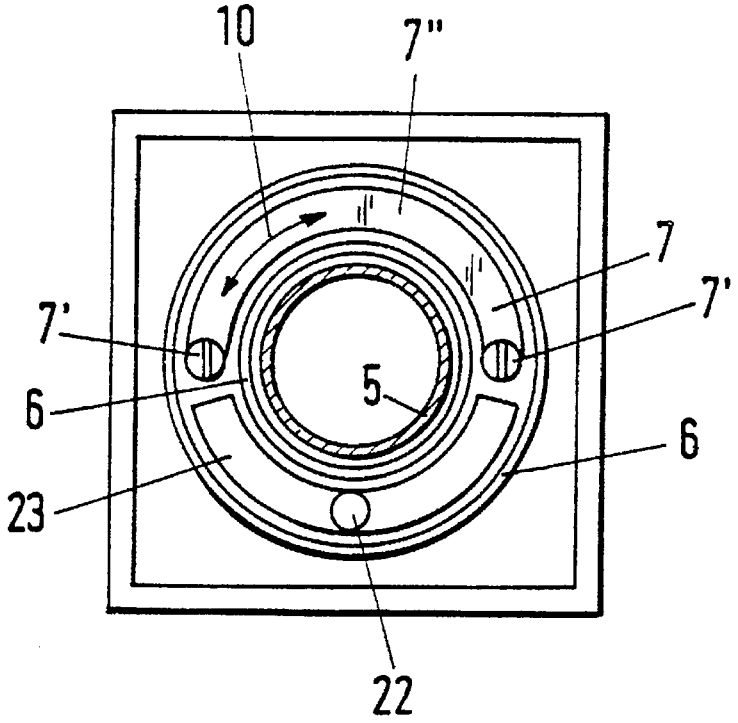

The lamp 7, 7' and the lamp housing 6 is attached to a moveable lifting and pivoting apparatus 9 which on the one hand is pivotable in the direction of the double arrow 10 in FIG. 2, and on the other hand can be lifted in the direction of the double arrow 8 in FIG. 1 up and down in the vertical direction. The electrical connections for the lamp 7 are designated 11. The lamp housing 6 is made from quartz glass.

A fixed connector 12 in the form of a hollow annular space is attached to the filler pipe 5 in the upper area, at a distance from the lifting and pivoting apparatus 9, with a supply line 13 for sterile gas. Between this fixed connector 13 and the lifting and pivoting apparatus 9, a flexible bellows 14 is arranged in a gas tight manner such that a sterile gas entering the supply line 13 and the annular, hollow connector 12 according to the arrow 15 (FIG. 4), arrives in the inside of the bellows 14 as this forms an annular space around the filler pipe. The sterile gas flows out of the flexible bellows 14 along the external surface of the filler pipe 5, sweeping downwards, through the annular space and downwardly adjacent to the bottom edge 16 of the filler pipe 5 according to the arrow 17. The sterile gas flows upwards through the annular space 19 between the filler pipe 5 and lamp housing 6 on the one hand and the package wall 2 on the other hand and escapes according to the curved arrows 18. In the embodiment according to FIGS. 1 to 4, the supply of sterile gas according to the arrow 15 and escape according to the arrows 17 or 18 is continuous during all of the operating steps I to V in FIG. 4.

In the embodiments shown here, the closed bottom end 3 of the package 1 later forms the lid, while the base is produced by folding. This folding is done by the sealing jaws 20, which in the embodiment according to FIG. 5 are shown as a sonotrode 20' with counter jaws 20". These sealing jaws 20, 20', 20" complete an arc-shaped movement along the arrow 21 (FIG. 4, IV) and back (not shown) to perform the closing movement.

During operation cold water enters at the top in the distribution line 22 (FIG. 2) and by means of two lateral auxiliary lines 23 into the space in the housing 6 in order to cool the lamp 7.

Figure 3:
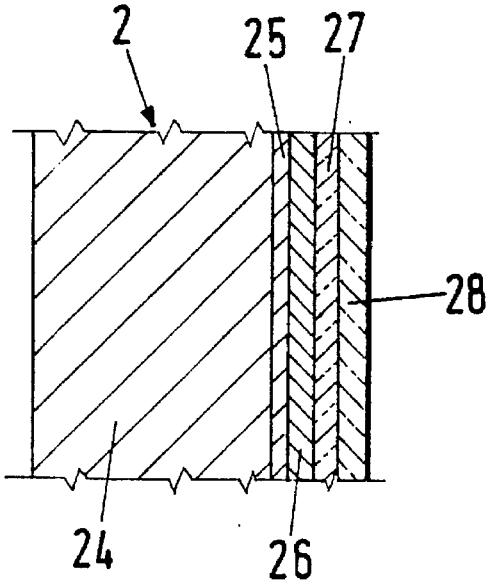
Figure 4:
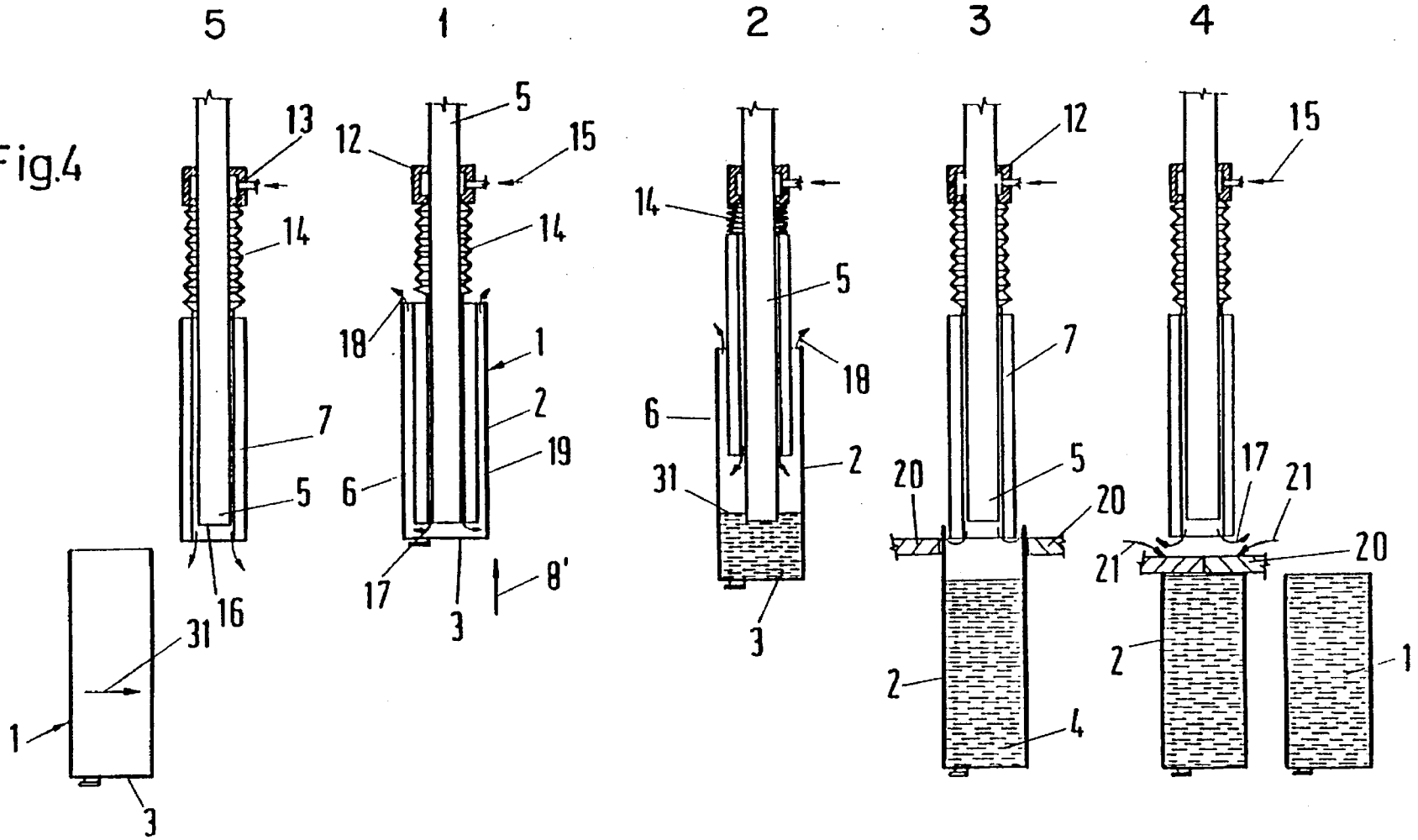

If the tubular wall 2 of the package 1 according to FIG. 1 were cut open and very greatly enlarged, a cross-section of the material could be seen as is shown in FIG. 3. The outside of the package is shown on the left and the inside of the package on the right. Onto a support material 24 which is externally coated with plastics material which is not shown, a metallic layer 26 is applied over a layer of bonding agent 25 onto a glass layer 27 vapour deposited in plasma onto a polypropylene layer 28.

Figure 5:
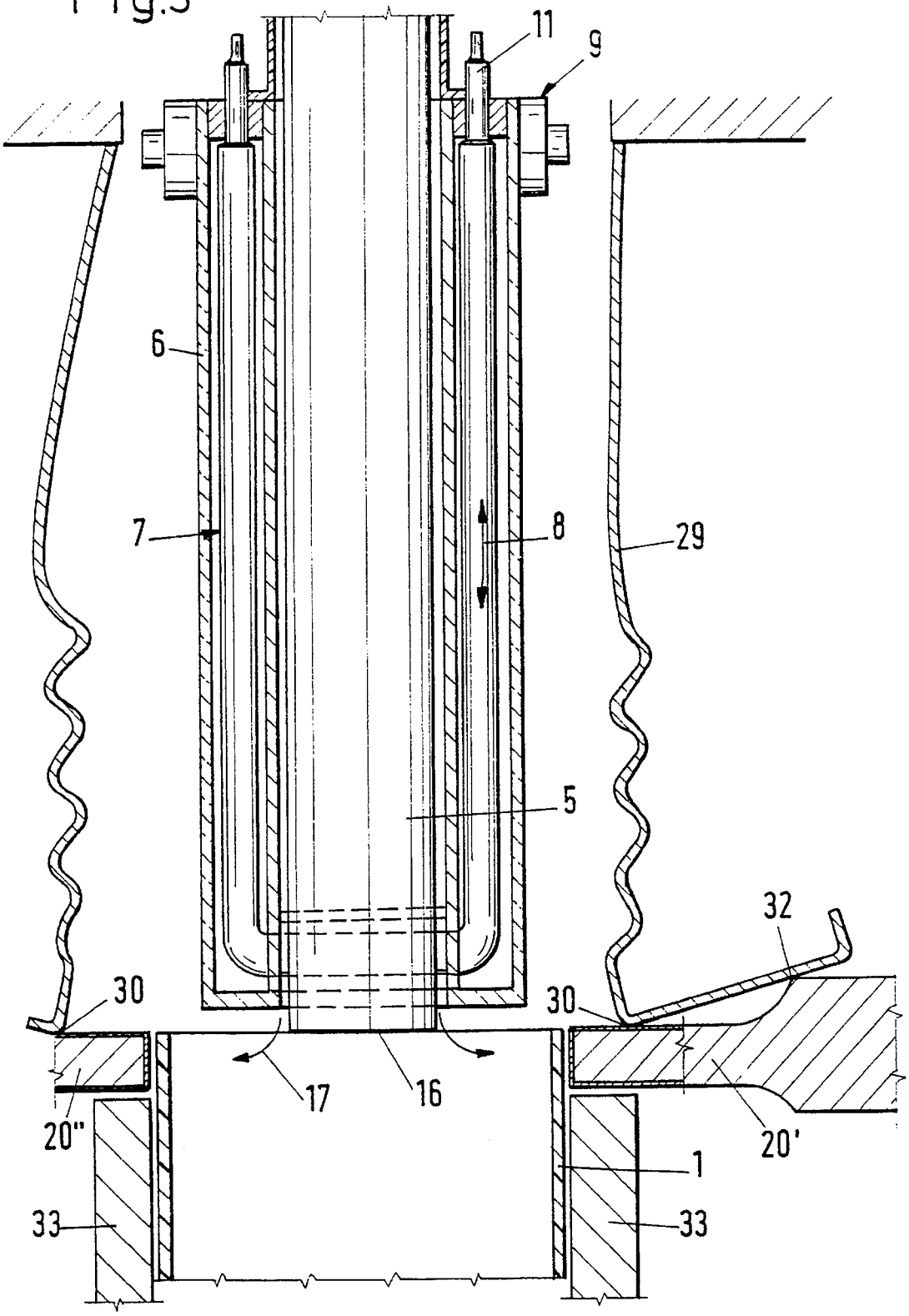

The embodiment according to FIG. 5 differs from that according to FIG. 1 simply in that a flexible sleeve 29 is arranged externally around the whole area of the lamp 7 and is retained on the sealing jaws 20', 20" along an annular line 30 such that a space with aseptic gas can be maintained above the package 1 when the sealing jaws 20', 20" are moved away to the centre according to the curved arrow 21 to close the base of the package. The sleeve 29 can, for example, be fitted at the point 32 (for example a straight line) onto the sealing jaws 20', 20".

The driving of the device according to the invention is best explained with reference to FIG. 4. In position 1, the package 1, open on one side has been moved in its holder, which is not shown, upwards in the direction of lifting 8' sufficiently far for the closed bottom end 3 of the package to lie closely adjacent to the bottom edge 16 of the filler pipe 5. Sterile gas 15 is now conducted into the annular connector 12 and flows out through the flexible bellows 14 along the filler pipe 5 inside the lamp housing 6 and escapes according to the curved arrows 17 at the bottom, closed end 3 of the package 1 in order to sterilize this wall, which will later form the lid of the package, and then rises along the tubular wall 2 until the sterile air can escape according to the arrow 18.

During this pre-sterilization the lamp 7 is switched on and emits high energy light impulses, for example by discharges at a frequency of 20 per second.

These emitted light impulses are suitable for killing bacteria present on the lamp housing 6 and in particular on the package 1. With the aid of the lifting and pivoting apparatus 9, the lamp housing 6 is pivoted backwards and forwards according to the double arrow 10 (FIG. 2) in order to bring the rod-shaped, vertically arranged arms 7' of the U-shape of the discharge lamp 7 into the closest possible light contact with all the areas of the surfaces to be sterilized. With a cycle time of, for example 1.9 seconds, the switched-on lamp required approximately 0.3 seconds for sterilisation. While the sterilizing medium, that is to say the sterilizing gas 15–18 continues to flow, the lamp 7 is switched off and moved upwards in the lifting direction 8', after which liquid flows down through the filler pipe 5 and begins to fill the package 1. The state II according to FIG. 4 is now reached.

The package 1 is moved downwards at a speed determined according to the inflow of the liquid so that the level of liquid 31 is always approximately in the area of the bottom edge 16 of the filler pipe 5. The bellows 14 are compressed because the top end of the lamp housing 6 has now been moved nearer to the fixed connector 12.

In order to reach position III, the lamp 7 is moved downwards sufficiently far in a direction opposite to the arrow 8' so that the bottom end of the lamp housing lies just above the connection line of the sealing jaws 20. The top end of the package 1, open on one side, is also located at this height as can clearly be seen in position III. In this way only a very narrow annular gap or rectangular gap is maintained within the sealing jaws 20, so that only a little of the sterile gas escapes according to the curved arrow 17. The bellows 14 has meanwhile expanded back into its normal elongated form.

As the package 1 is completely filled with the contents 4, the package must now be also sealed, namely by folding, at the area which will later form its base. This is done by bringing together the two sealing jaws 20 according to the curved arrow 21 as is shown in position IV. Here, the folded bottom has already been closed and is sealed in a liquid-proof manner.

After this, the sealing jaws 20 move back outwards to the initial position in the opposite direction to the direction of the arrow 21, and the package is moved away to the right.

Meanwhile in the position V a new package 1 can be transported in the direction of the arrow 31 shown, under the lamp housing 6 and filler pipe 5, arranged and again moved upwards in the direction of lifting 8' so that the position I is reached, whereafter the example of operations described is repeated.

The package 1 is arranged according to FIG. 5 adjacent to a casing-like holder 33 to accomplish the completion underneath of the sterile space. It can be seen that this holder 33 is arranged at a small distance from the sealing jaws 20', 20". It moves together with the sealing jaws, and relatively to the package 1, while retaining this distance.

I claim:

1. A process for sterilizing and filling packages for flowable media under the influence of pulsating light and with the use of a filler pipe, wherein the packages are open on one side thereof for filling, said process comprising the steps of:

a) providing a package having an open end and a closed end;

b) providing a filler pipe having a filling end thereof;

c) providing a pulsating light source;

d) enclosing the filler pipe and light source within the package by moving the package sufficiently far relative to the filler pipe and the light source so that the filling end of the filler pipe is located proximate the closed end of the package;

e) blowing a sterile gas into the package;

f) shining light with the light source into the package;

g) shutting off the light source;

h) maintaining the filler pipe in a stationary position and moving the light source in a direction away from the package bottom and moving the package in the other direction away from said light source;

i) maintaining the filler pipe in a position and filling the package with the filler pipe while moving the package away from said light source;

j) closing the package and moving the package onward.

2. The process according to claim 1, including the step of maintaining an atmosphere of sterile gas within the package during the entire blowing, filling and closing steps.

3. The process according to any one of claims 1 or 2, including the step of sweeping sterile gas over the surface of the filler pipe during the entire process.

4. An apparatus for sterilizing and filling packages for flowable media, wherein said packages have a package wall and are open on one side thereof for filling with a filler pipe, and wherein a lamp emitting a pulsating light is provided, said apparatus comprising:

a) a filler pipe supported by said apparatus and having an open end and being movable relative to said package, including within said package to define a space between said filler pipe and said package wall;

b) a lamp housing containing a coolant medium for cooling of said lamp, said lamp housing being drivably provided for movement in the space between the filler pipe and the package wall;

c) a lamp carried by said lamp housing emitting a pulsating light and being movable in relation to said package and in relation to said filler pipe, said lamp being provided to be movable in relation to said filler pipe when said filler pipe remains stationary; and d) supply line means for supplying sterile gas into the interior of the package.

5. The apparatus of claim 4, further comprising lifting and pivoting means, wherein the lamp and lamp housing are attached to the lifting and pivoting means and surround said filler pipe, and wherein the lamp is provided having a substantially vertical height approximating the substantially vertical height of the package.

6. The apparatus of claim 5, further comprising a flexible bellows attached to and surrounding said filler pipe and connected to the lifting and pivoting means in an air-tight manner, wherein a fixed connector member is provided to surround said filler pipe at an end opposite the filling end of said filler pipe, and wherein said bellows is attached to said connector member.

7. The apparatus of any one of claim 6, further comprising movable sealing jaws provided proximate to the outside bottom edge of the filler pipe.

8. The apparatus of any one of claim 7, further comprising a flexible sleeve provided in surrounding relation to said lamp housing, said sleeve being connected at one end thereof in a gas-tight manner to the fixed connector member with the other end thereof being retained on said sealing jaws.

9. The apparatus of any one of claims 5 or 6, wherein the lamp in the lamp housing is provided having a U-shaped configuration.

10. The apparatus of claim 9, wherein the lamp housing is provided having an annular configuration and surrounding the lamp, and wherein the U-shaped lamp is provided having a pair of vertical arms and a curved horizontal tab portion connecting said arms.

* * * * *